United States Patent [19]

Sakanoue et al.

[11] Patent Number: 4,791,051

[45] Date of Patent: Dec. 13, 1988

[54] SILVER HALIDE COLOR PHOTOGRAPHIC MATERIAL COMPRISING A POLYMERIC MAGENTA COUPLER AND A PHENOLIC CYAN COUPLER

[75] Inventors: Kei Sakanoue; Tsumoru Hirano, both of Kanagawa, Japan

[73] Assignee: Fuji Photo Film Co., Ltd., Kanagawa, Japan

[21] Appl. No.: 862,848

[22] Filed: May 13, 1986

[30] Foreign Application Priority Data

May 13, 1985 [JP] Japan ..... 60-99497

[51] Int. Cl.[4] ..... G03C 7/32

[52] U.S. Cl. ..... 430/548; 430/505; 430/552; 430/553; 430/555

[58] Field of Search ..... 430/505, 548, 553, 552, 430/555

[56] References Cited

U.S. PATENT DOCUMENTS 4,128,427 12/1978 Monbaliu et al. ..... 430/740

4,513,079 4/1985 Sakanone et al. ..... 430/740

*Primary Examiner*—Paul R. Michl

*Assistant Examiner*—Patrick A. Doody

*Attorney, Agent, or Firm*—Sughrue, Mion, Zinn, Macpeak, and Seas

[57] ABSTRACT

A silver halide color photographic material is disclosed, comprising a support and at least silver halide emulsion layers on the support, wherein at least one of said emulsion layers contains at least one 2-equivalent 5-pyrazolone polymer coupler and at least one of the other emulsion layers contains at least one phenol cyan coupler having an acylamino group in the 5-position and a ureido group in the 2-position. The present material is advantageous over conventional materials in that the color balance of the image dyes remains unchanged over long periods of time.

12 Claims, No Drawings

SILVER HALIDE COLOR PHOTOGRAPHIC MATERIAL COMPRISING A POLYMERIC MAGENTA COUPLER AND A PHENOLIC CYAN COUPLER

FIELD OF THE INVENTION

The present invention relates to a silver halide color photographic material, and more particularly to a silver halide color photographic material in which the color balance in image dyes remains unchanged over long periods of time. This silver halide color photographic material is hereinafter sometimes called a "color light-sensitive material".

BACKGROUND OF THE INVENTION

In recent years the image quality of color light-sensitive material has been significantly increased; a print of good quality can be obtained even with a small-sized format. However the storage stability of image dyes is not sufficiently satisfactory. It can be said that the fastness of each colored dye has been increased. It is, however, insufficient to increase the fastness of a particular colored dye of specific hue, because if the fastness of a particular colored dye of specific hue alone is increased, the color balance is lost and no good storage stability can be obtained. Accordingly, in order to increase the storage stability of images, it is important that all colored dyes have uniform fastness, such that even if the dyes are deteriorated during the storage, the fading in the dyes is uniform as a whole; i.e., the fading is well balanced.

In connection with cyan images, conventionally used cyan couplers (i.e., cyan-dye-forming couplers) such as a 2-acylaminophenyl cyan coupler as described in U.S. Pat. Nos. 2,367,561 and 2,423,730, and a 2,5-diacylaminophenol cyan coupler and a 1-hydroxy-2-naphthoamide cyan coupler as described in U.S. Pat. Nos. 2,369,929 and 2,772,162 are generally unsatisfactory in respect of light and/or heat fastness. As an improved cyan coupler, a phenol cyan coupler having a ureido group in the 2-position as described in U.S. Pat. Nos . 3,446,622, 3,996,253, 3,758,308, 3,880,661, 4,451,559, and Japanese patent application (OPI) No. 65134/81 (U.S. Pat. No. 4,333,999) (the term "OPI" as used herein means a "published unexamined Japanese patent application") is known. This phenol cyan coupler is greatly improved in light and heat fastness over the above conventional couplers.

In connection with the stability of magenta color image, it is generally known that a 4-equivalent 5-pyrazolone coupler which is commonly used has disadvantages in that although it is relatively high in heat fastness, its light fastness is poor, and that if the coupler remains unreacted after the processing, the unreacted coupler reacts with a magenta dye, thereby seriously reducing the heat fastness.

A high quality film has been greatly demanded in recent years. It has been found that if the 4-equivalent magenta polymer coupler as described in Japanese patent application (OPI) Nos. 28745/83 (U.S. Pat. No. 4,409,320) and 120252/83 is used, the thickness of an emulsion layer can be significantly decreased, as a result of which light-scattering is reduced and sharpness can be greatly improved. This polymer coupler, however, is not sufficiently satisfactory because it is poor in heat fastness and thus the stability of color image is unsatisfactory.

SUMMARY OF THE INVENTION

An object of the present invention is to provide a color light-sensitive material which is excellent in sharpness and further in image stability.

Another object of the present invention is to provide a color light-sensitive material which is well balanced in the fading of cyan and magenta color images.

Other objects and features of the present invention will become apparent from the following description.

It has been found that these objects can be attained by incorporating a 2-equivalent 5-pyrazolone polymer coupler in at least one layer of silver halide emulsion layers provided on a support and a phenol cyan coupler substituted with an acylamino group in the 5-position and a ureido group in the 2-position into at least one other silver halide emulsion layer.

According to the present invention there is to provided a silver halide color photograhic material comprising a support and at least two silver halide emulsion layers on the support wherein at least one of the silver halide emulsion layers contains at least one 2-equivalent 5-pyrazolone polymer coupler and at least one other silver halide emulsion layer contains at least one phenol cyan coupler which is substituted with an acylamino group in the 5-position and a ureido group in the 2-position.

DETAILED DESCRIPTION OF THE INVENTION

The 2-equivalent 5-pyrazolone polymer coupler according to the present invention is preferably a compound derived from a monomer coupler represented by formula (I) and has a repeating unit represented by formula (II).

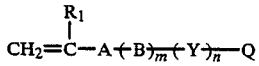

(I)

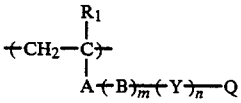

(II)

In formulae (I) and (II), $R_1$ represents a hydrogen atom, a lower alkyl group having from 1 to 4 carbon atoms, or a chlorine atom, A represents —CONH—, —COO—, —O—, or a phenylene group, B represents an unsubstituted or substituted straight or branched alkylene group, aralkylene group, or phenylene group, Y represents —CONR'—, —NR'CONR'—, —NR'COO—, —NR'CO—, —OCONR'—, —NR'—, —COO—, —OCO—, —CO—, —O—, —$SO_2$—, —NR'$SO_2$— or —$SO_2$NR'—, wherein R' represents a hydrogen atom or substituted or unsubstituted aliphatic group or aryl group, and when two or more R's are present in one molecule, R's may be same or different.

n is 0 or 1, m is 0 when n is 0, or 1 when n is 1, and

Q represents a 2-equivalent magenta coupler group forming a dye on coupling with an oxidized product of an aromatic primary amine developing agent, preferably a pyrazolone group having the structure represented by formula (III) or (IV).

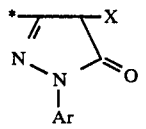

(III)

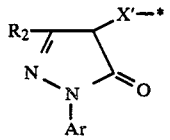

(IV)

In formulae (III) and (IV), the symbol * indicates a site where the group is linked to $-(Y)_n-$.

In formulae (III) and (IV),

Ar represents an alkyl group, a substituted alkyl group (e.g., haloalkyl such as fluoroalkyl, cyanoalkyl and benzylalkyl), or a substituted or unsubstituted aryl group. Examples of the substituent include an alkyl group (e.g., a methyl group and an ethyl group), an alkoxyl group (e.g., a methoxy group and an ethoxy group), an aryloxy group (e.g., a phenyloxy group), an alkoxycarbonyl group (e.g., a methoxycarbonyl group), an acylamino group (e.g., an acetylamino group), a carbamoyl group, an alkylcarbamoyl group (e.g., a methylcarbamoyl group and an ethylcarbamoyl group), a dialkylcarbamoyl group (e.g., a dimethylcarbamoyl group), an arylcarbamoyl group (e.g., a phenylcarbamoyl group), an alkylsulfonyl group (e.g., a methysulfonyl group), an arylsulfonyl group (e.g., a phenylsulfonyl group), an alkylsulfonamido group (e.g., a methanesulfonamido group), an arylsulfonamido group (e.g., a phenylsulfonamido group), a sulfamoyl group, an alkylsulfamoyl group (e.g., an ethylsulfamoyl group), a dialkylsulfamoyl group (e.g., a dimethylsulfamoyl group), an alkylthio group (e.g., a methylthio group), an arylthio group (e.g., a phenylthio group), a cyano group, a nitro goup, and a halogen atom (e.g., fluorine, chlorine and bromine); when the aryl group is substituted with two or more substituents, they may be the same or different.

When Ar is an aryl group, preferred examples of the substituent are a halogen atom, an alkyl group, an alkoxyl group, an alkoxycarbonyl group, and a cyano group. A particularly preferred substituent is a halogen atom.

$R_2$ is a substituted or unsubstituted anilino group, an acylamino group (e.g., an alkylcarbonamido group, a phenylcarbonamido group, an alkoxycarbonamido group and a phenyloxycarbonamido group), or a ureido group (e.g., an alkylureido group and a phenylureido group) and preferably is acylamino group. The substituent includes a halogen atom (e.g., a fluorine atom, a chlorine atom, and a bromine atom), a straight, branched or cyclic alkyl group (e.g., a methyl group, a tert-butyl group, an octyl group, a tetradecyl group, and a cyclohexyl group), an alkoxyl group (e.g., a methoxy group, an ethoxy group, a 2-ethylhexyloxy group, and a tetradecyloxy group), an acylamido group (e.g., an acetamido group, a benzamido group, a butaneamido group, an octaneamido group, a tetradecaneamido group, an α-(2,4-di-tert-amylphenoxy)acetamido group, an α-(2,4-di-tert-amylphenoxy)-butylamido group, an α-(3-pentadecylphenoxy)hexaneamido group, an α-(4-hydroxy-3-tert-butylphenoxy)tetradecaneamido group, a 2-oxo-pyrolidine-1-yl group, a 2-oxo-5-tetradecylpyrolidine-1-yl group, and an N-methyl-tetradecaneamido group), a sulfonamido group (e.g., a methanesulfonamido group, a benzenesulfonamido group, an ethylsulfonamido group, a p-toluenesulfonamido group, an octanesulfonamido group, a p-dodecylbenzenesulfonamido group, and an N-methyltetradecanesulfonamido group), a sulfamoyl group (e.g., a sulfamoyl group, an N-methylsulfamoyl group, an N-ethylsulfamoyl group, an N,N-dimethylsulfamoyl group, an N,N-dihexylsulfamoyl group, an N-hexadecylsulfamoyl group, an N-[3-(dodecyloxy)-propyl]sulfamoyl group, an N-[4-(2,4-ditert-amylphenoxy)butyl]sulfamoyl group, and an N-methyl-N-tetradecylsulfamoyl group), a carbamoyl group (e.g., an N-methylcarbamoyl group, an N-butylcarbamoyl group, an N-octadecylcarbamoyl group, an N-[4-(2,4-di-tert-amylphenoxy)butyl]carbamoyl group, and an N-methyl-N-tetradecylcarbamoyl group), a diacylamino group (e.g., N-succinamido group, an N-phthalimido group, a 2,5-dioxo-1-oxazolidinyl group, a 3-dodecyl-2,5-dioxo-1-hydantoinyl group, and a 3-(N-acetyl-N-dodecylamino)succinimido group), an alkoxycarbonyl group (e.g., a methoxycarbonyl group, a tetradecyloxycarbonyl group and a benzyloxycarbonyl group), an alkoxysulfonyl group (e.g., a methoxysulfonyl group, a butoxysulfonyl group, an octyloxysulfonyl group, and a tetradecyloxysulfonyl group), an aryloxysulfonyl group (e.g., a phenoxysulfonyl group, a p-methylphenoxysulfonyl group, and a 2,4-di-tert-amylphenoxysulfonyl group), an alkanesulfonyl group (e.g., a methanesulfonyl group, an ethanesulfonyl group, an octanesulfonyl group, a 2-ethylhexylsulfonyl group, and a hexadecanesulfonyl group), an arylsulfonyl group (e.g., a benzenesulfonyl group and a 4-nonylbenzenesulfonyl group), an alkythio group (e.g., a methylthio group, an ethylthio group, a hexylthio group, a benzylthio group, a tetradecylthio group, and a 2-(2,4-di-tert-amylphenoxy)ethylthio group), an arylthio group (e.g., a phenylthio group and a ptolylthio group), an alkyloxycarbonylamino group (e.g., a methoxycarbonylamino group, an ethyloxycarbonylamino group, a benzyloxycarbonylamino group, and a hexadecyloxycarbonylamino group), an alkylureido group (e.g., an N-methylureido group, an N,N-dimethylureido group, an N-methyl-N-dodecylureido group, an N-hexadecylureido group, and an N,N-dioctadecylureido group), an acyl group (e.g., an acetyl group, a benzoyl group, an octadecanoyl group, and a p-dodecaneamidobenzoyl group), a nitro group, a carboxyl group, a sulfo group, a hydroxyl group, or a trichloromethyl group.

Of the above groups, the alkyl group has from 1 to 36 carbon atoms and the aryl group has from 6 to 38 carbon atoms.

X is a coupling-releasable group linked to the coupling position through a nitrogen atom, a sulfur atom or an oxygen atom and most preferably through a nitrogen atom. These atoms are bound to an alkyl group, an aryl group, an alkylsulfonyl group, an arylsulfonyl group, an alkylcarbonyl group, an arylcarbonyl group, or a heterocyclic group (the alkyl group, the aryl group and the heterocyclic group may have the groups shown as the substituent of the aryl group for Ar). In the case of a nitrogen atom, groups containing the nitrogen atom and capable of becoming a releasable group on forming a heterocyclic ring are included. Typical examples of such groups are an imidazolyl group, a pyrazolyl group, a triazolyl group and a tetrazolyl group.

Particularly preferred examples of the releasable group are nitrogen atom-containing releasable groups forming a heterocyclic ring such as an imidazolyl group and a pyrazolyl group.

X' represents a divalent group, derived from X, having bonding sites to pyrazolone ring and to $-(Y)_n-$.

The polymer coupler of the present invention may be a homopolymer of a monomer coupler represented by formula (I), or a copolymer of two or more of monomer couplers represented by formula (I), or a copolymer of a monomer coupler of formula (I) and a non-color-forming ethylenic monomer which does not couple with an oxidized product of an aromatic primary amine developing agent. Even in this case, as the monomer coupler of formula (I), a copolymer comprising two or more of the monomer couplers represented by formula (I) together with one or more of a non-color-forming ethylenical monomers may be used.

Of the above polymers, a copolymer of a monomer coupler of formula (I) and a non-color forming ethylenical monomer as described hereinafter is preferred.

The ethylenical monomer not forming color on coupling with an oxidized product of an aromatic primary amine developing agent includes acrylic acid, α-chloroacrylic acid, α-alkylacrylic acid (e.g., methacrylic acid), and their ester or amide derivatives (e.g., acrylamide, methacrylamide, n-butylacrylamide, tert-butylacrylamide, diacetoneacrylamide, methylenebisacrylamide, methyl methacrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxyl methacrylate), vinyl esters (e.g., vinyl acetate, vinyl propionate and vinyl laurate), acrylonitrile, methacrylonitrile, aromatic vinyl compounds (e.g., styrene and its derivatives, such as vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid esters, N-vinyl-2-pyrrolidone, N-vinylpyridine, and 2- and 4-vinylpyridine.

Particularly preferred examples are acrylic acid esters, methacrylic acid esters, and maleic acid esters. The above non-color forming ethylenically unsaturated monomers can be used as mixtures comprising two or more thereof. Typical examples are a combination of methyl acrylate and butyl acrylate, a combination of butyl acrylate and styrene, a combination of butyl methacrylate and methacrylic acid, and a combination of methyl acrylate and diacetone acrylamide.

As is well known in the polymer coupler field, the type of the ethylenically unsaturated monomer to be copolymerized with the monomer coupler of the general formula (I) can be chosen appropriately so as to exert favorable influences on the physical and/or chemical properties of the resulting copolymer, such as solubility, compatibility with a binder (e.g., gelatin) of a photographic colloid composition, flexibility, and heat stability.

The magenta polymer coupler as used herein is conveniently handled in the form of a latex during the preparation of light-sensitive material. This latex can be prepared by two methods: one of the methods is such that an oleophilic polymer coupler as prepared by polymerization of the above monomer coupler is dissolved in an organic solvent and then dispersed or emulsified in an aqueous gelation solution, and the other method is a direct emulsion polymerization method. The former method is described in U.S. Pat. No. 3,451,820, and the latter method is described in U.S. Pat. Nos. 4,080,211 and 3,370,952.

As a polymerization initiator and a polymerization solvent for use in the synthesis of the magenta polymer coupler of the present invention, compounds as described in Japanese patent application (OPI) Nos. 5543/81, 94752/82 (U.S. Pat. No. 4,367,282), 176038/82 (U.S. Pat. No. 4,388,404), 204038/82 (U.S. Pat. No. 4,416,978), 28745/83 (U.S. Pat. No. 4,409,320), 10738/83, 42044/83, 145944/83 (U.S. Pat. No. 4,436,808), 224352/83 and 42543/84 (German Pat. No. 2,127,984B) can be used.

The polymerization temperature is determined taking into consideration the molecular weight of the polymer formed, the type of the polymerization initiator, and so forth. The polymerization temperature can be between 0° and 100° C.; usually the polymerization is carried out in a range of from 30° to 100° C.

The proportion of the color-forming portion of the monomer of formula (I) in the copolymer coupler is usually from 5 to 80 wt%. In view of color reproductivity, color forming properties and stability, the proportion is preferably from 20 to 70 wt%. In this case, the molecular weight equivalent (number of grams of the polymer containing 1 mol of the monomer coupler) is preferably from about 250 to 4,000 although it is not limited thereto.

Suitable examples of the 2-equivalent 5-pyrazolone couplers used according to the present invention are shown below, although the present invention is not limited thereto.

C-1

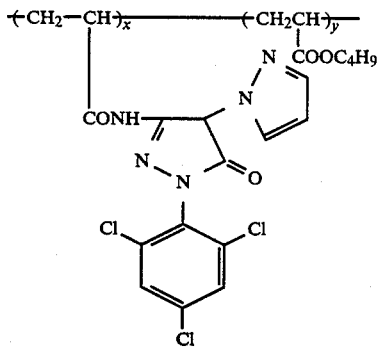

x/y = 50/50 (wt)

C-2

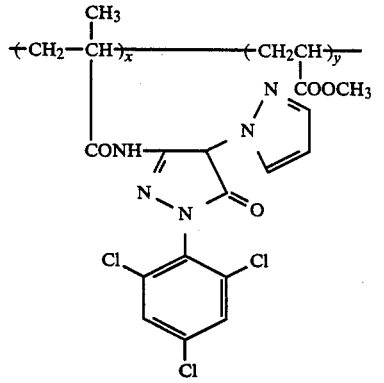

x/y = 50/50 (wt)

-continued
C-3
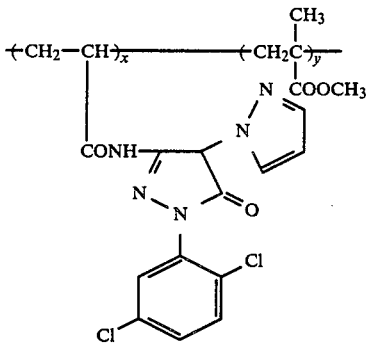
x/y = 60/40 (wt)
C-4
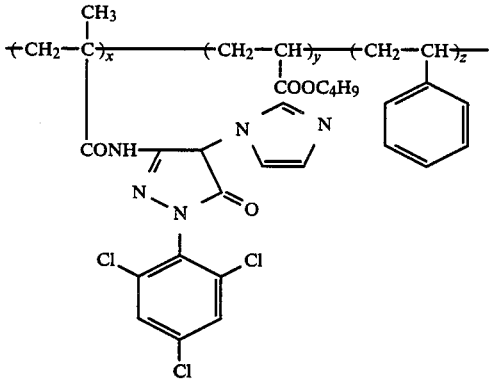
x/y/z = 50/25/25 (wt)
C-5
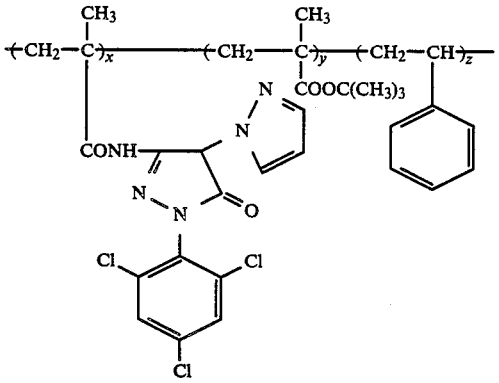
x/y/z = 50/25/25 (wt)
C-6
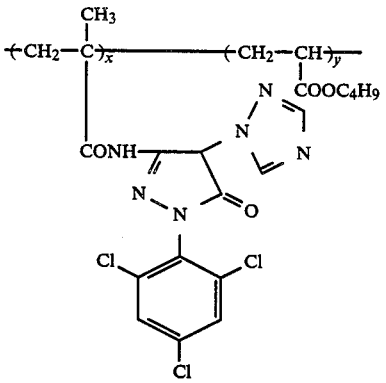
-continued
C-7
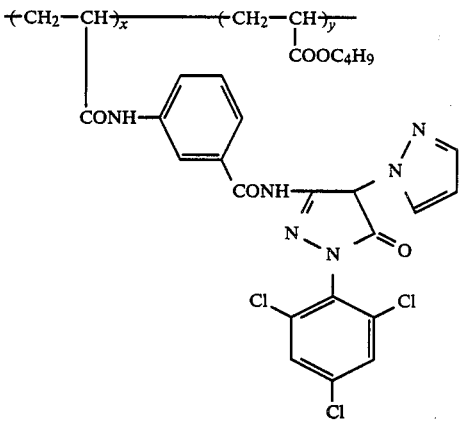
x/y = 50/50 (wt)
C-8
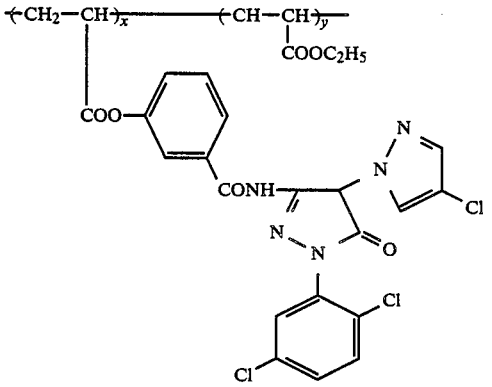
x/y = 70/30 (wt)
C-9
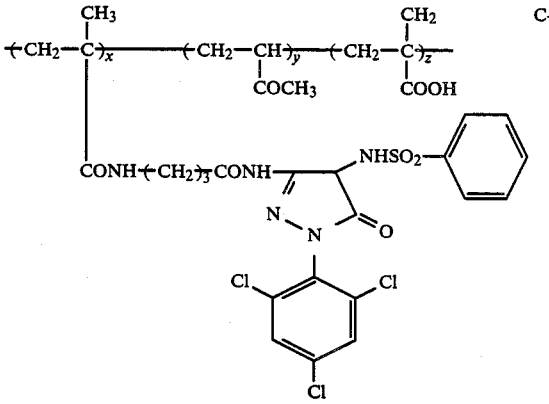
x/y/z = 60/35/5 (wt)

-continued
C-10
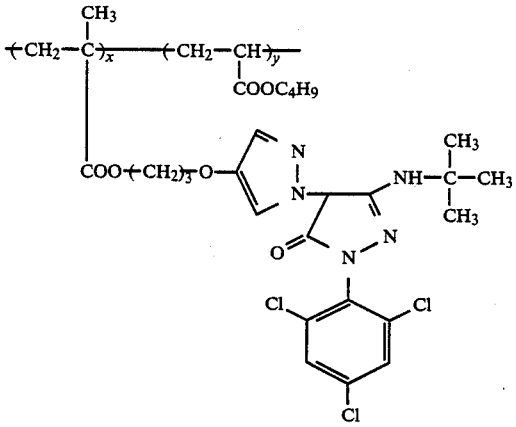
x/y = 70/30 (wt)
C-11
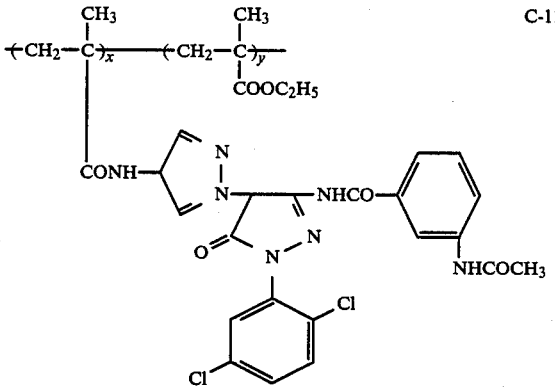
x/y = 50/50 (wt)
C-12
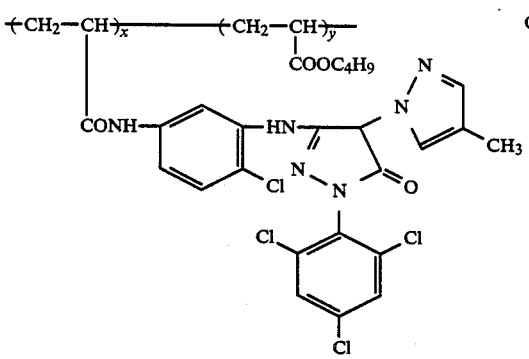
x/y = 40/60 (wt)
C-13
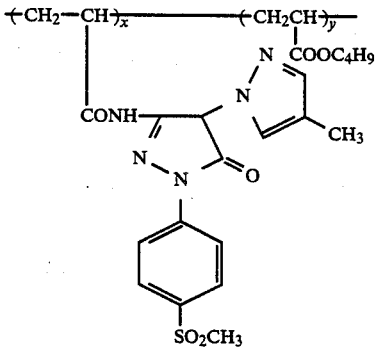
x/y = 50/50 (wt)
-continued
C-14
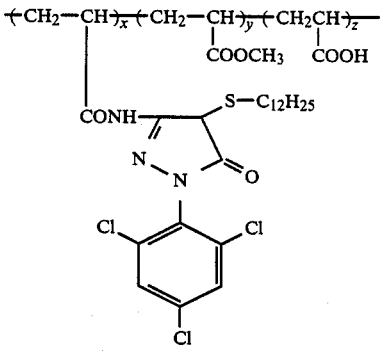
x/y/z = 50/40/5 (wt)
C-15
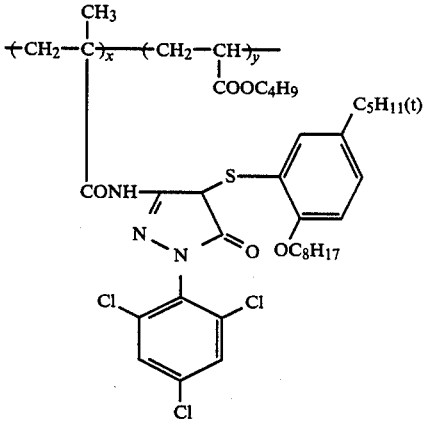
x/y = 50/50 (wt)
C-16
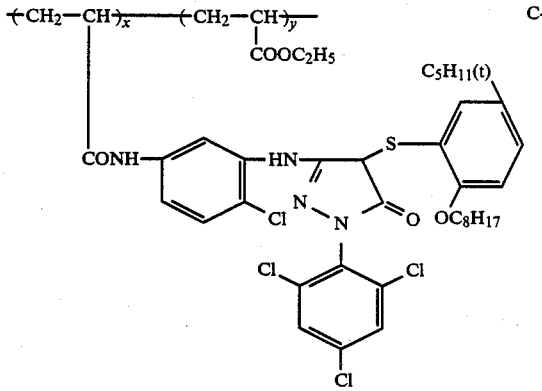
x/y = 50/50 (wt)
C-17
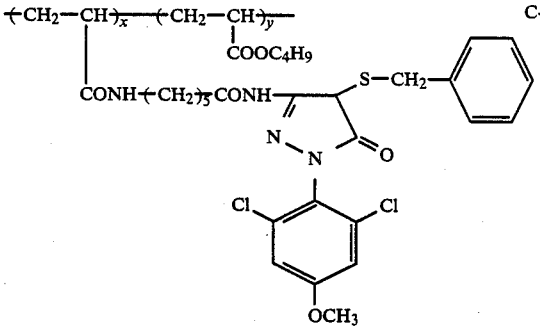
x/y = 65/35 (wt)

-continued

C-18

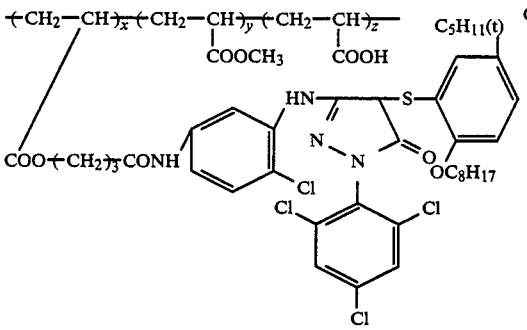

x/y/z = 70/25/5 (wt)

C-19

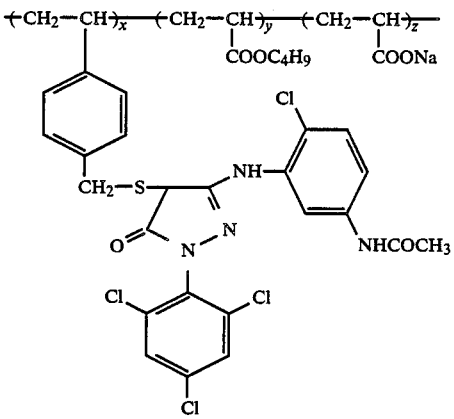

x/y/z = 45/51/4 (wt)

C-20

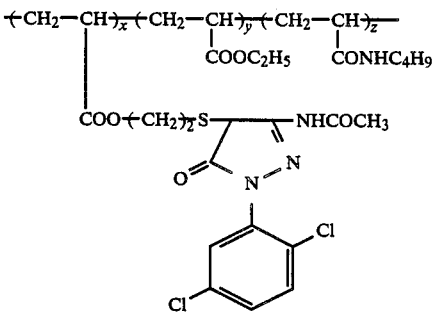

x/y/z = 50/30/20 (wt)

C-21

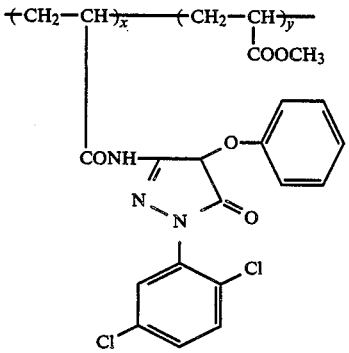

x/y = 50/50 (wt)

-continued

C-22

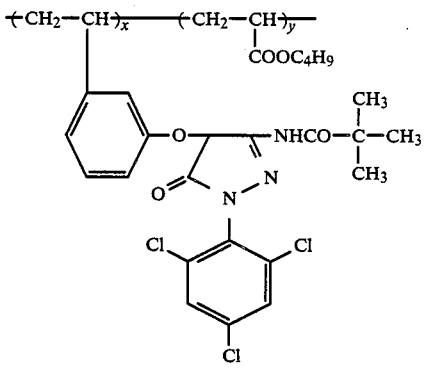

x/y = 60/40 (wt)

C-23

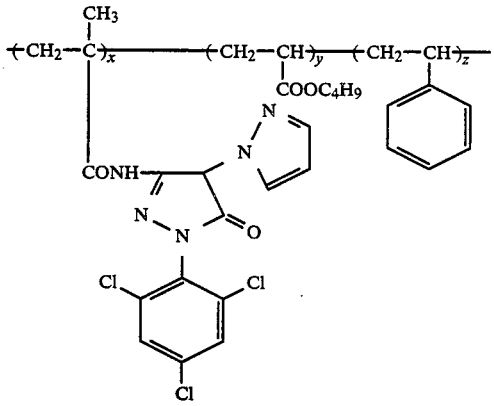

x/yz = 50/25/25 (wt)

Of the cyan couplers which are used in the present invention, particularly preferred phenol cyan couplers are represented by formula (V)

(V)

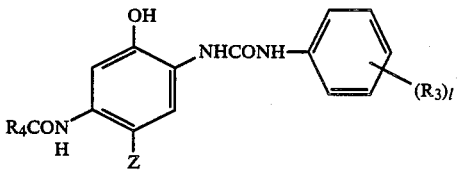

wherein $R_4$ represents a substituted or unsubstituted alkyl group, aryl group, or heterocyclic group, and preferably aryloxy substituted alkyl group;

$R_3$ represents a group selected from a hydrogen atom, a halogen atom, a sulfonyl group, a sulfonamido group, a sulfamoyl group, a polyfluoroalkyl group, an acryl group, an alkoxycarbonyl group, an acyl group, an amino group, and a cyano group, l is an integer of 1 to 5, and when l is two or more, groups represented by $R_3$ are the same or different, and Z represents a hydrogen atom or a group capable of being released at a time of oxidative coupling with a developing agent and preferably hydrogen atom, halogen atom or aryloxy group.

$R_4$ and Z of the general formula (V) will hereinafter be explained in detail.

$R_4$ is a chain-like or cyclic alkyl group preferably having 1 to 22 carbon atoms (e.g., a methyl group, a butyl group, a pentadecyl group, and a cyclohexyl group), an aryl group (e.g., a phenyl group and a naphthyl group), or a heterocyclic group (e.g., a 2-pyridyl group, a 4-pyridyl group, a 2-furanyl group, a 2-oxazolyl group, and a 2-imidazolyl group). These groups may be substituted with a substituent or substituents selected from an alkyl group, an aryl group, a heterocyclic group, an alkoxyl group (e.g., a methoxy group, a dodecyloxy group, and a 2-methoxyethoxy group), an aryloxy group (e.g., a phenoxy group, a 2,4-ditert-amylphenoxy group, a 3-tert-butyl-4-hydroxyphenoxy group, and a naphthyloxy group), a carboxyl group, a carbonyl group (e.g., an acetyl group, a tetraalkanoyl group and a benzoyl group), an ester group (e.g., methoxycarbonyl group, a phenoxycarbonyl group, an acetoxy group, a benzoyloxy group, a butoxysulfonyl group and a toluenesulfonyloxy group), an amido group (e.g., an acetylamino group, an ethylcarbamoyl group, a methanesulfonylamido group, and a butylsulfamoyl group), an imido group (e.g., a succinimido group and a hydantoinyl group), a sulfonyl group (e.g., a methanesulfonyl group), a hydroxyl group, a cyano group, a nitro group, and a halogen atom.

Z is a hydrogen atom or a halogen atom (e.g., a fluorine atom, a chlorine atom, and a bromine atom). The releasable group represented by Z further includes an alkoxyl group (e.g., an ethoxy group, a dodecyloxy group, a methoxyethylcarbamoylmethoxy group, a carboxymethoxy group, and a methylsulfonylethoxy group), an aryloxy group (e.g., a phenoxy group, a naphthyloxy group, and a 4-carboxyphenoxy group), an acyloxy group (e.g., an acetoxy group, a tetradecanoyloxy group, and a benzoyloxy group), a sulfonyloxy group (e.g., a methanesulfonyloxy group and a toluenesulfonyloxy group), an amido group (e.g., a dichloroacetylamino group, a heptafluorobutylylamino group, a methanesulfonylamino group, and a toluenesulfonyl group), an alkoxycarbonyloxy group (e.g., an ethoxycarbonyloxy group and a benzyloxycarbonyloxy group), an aryloxycarbonyloxy group (e.g., a phenoxycarbonyloxy group), and an imido group (e.g., a succinimido group and a hydantoinyl group).

In formula (V), it is preferred that $R_3$ be a halogen atom, a sulfonyl group, a sulfonamido group, a sulfamoyl group, a polyfluoroalkyl group, an acyl group, an alkoxycarbonyl group, or an acylamino group, l is 1 or 2, and the substituent be located in the m- or p-position relative to the ureido group.

Particularly preferably, $R_3$ is a sulfonyl group, a sulfonamido group, or a sulfamoyl group, and l is 1.

Preferred examples are shown below, although the present invention is not limited thereto.

D-1

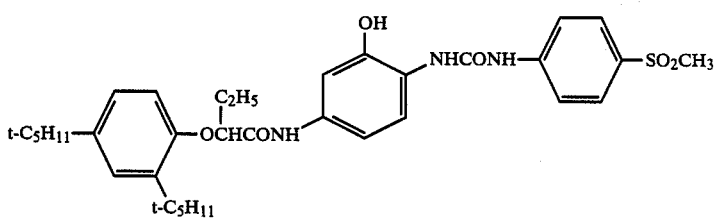

D-2

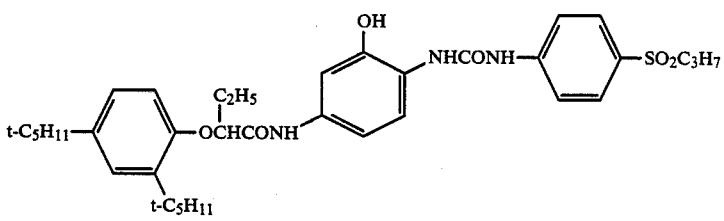

D-3

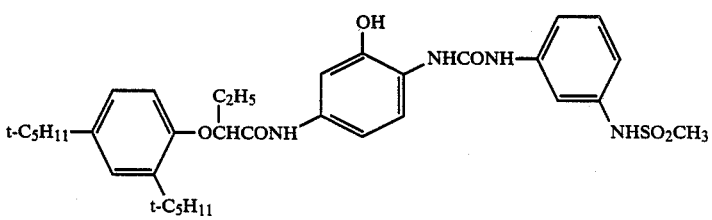

D-4

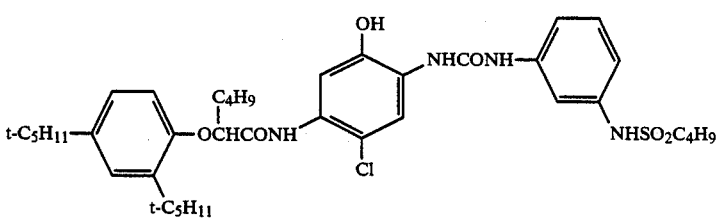

-continued
D-5
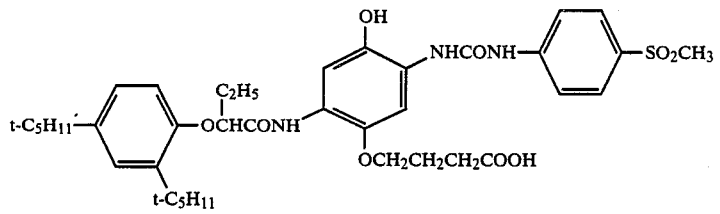
D-6
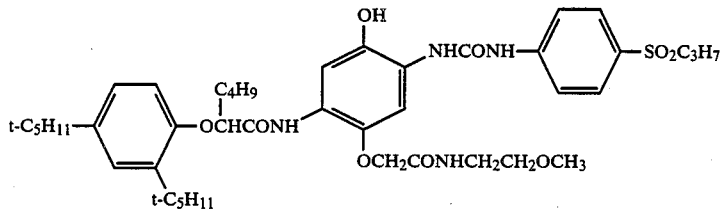
D-7
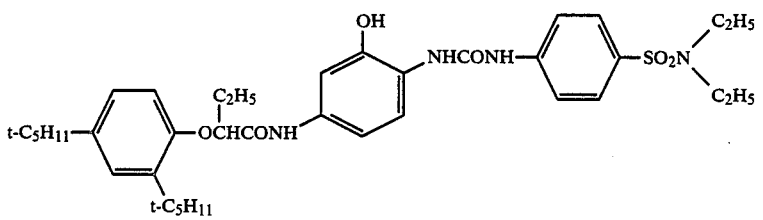
D-8
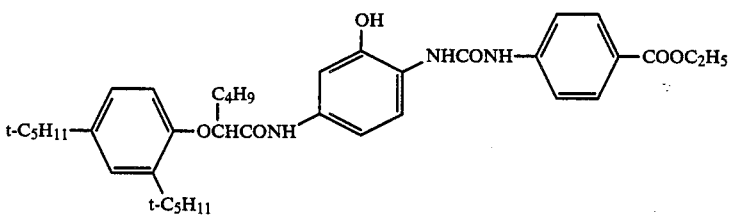
D-9
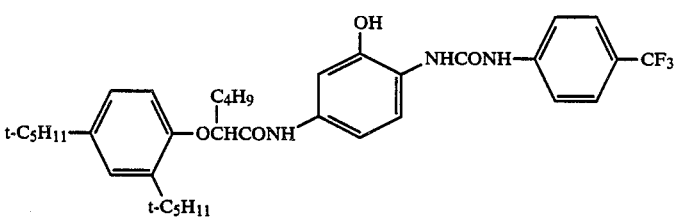
D-10
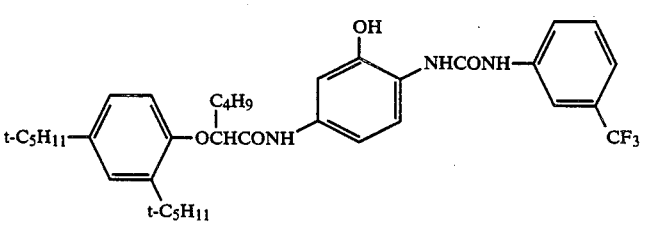
D-11
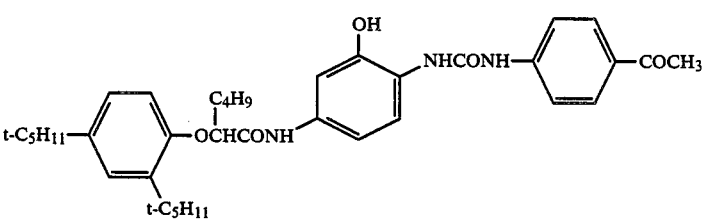

-continued
D-12
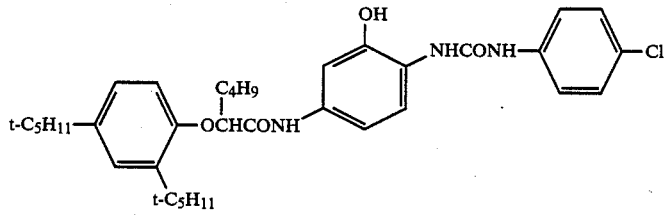
D-13
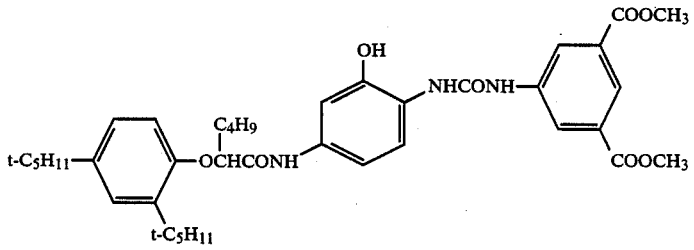
D-14
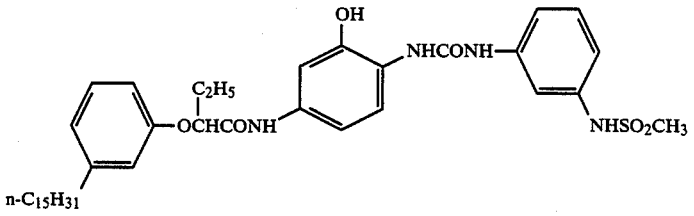
D-15
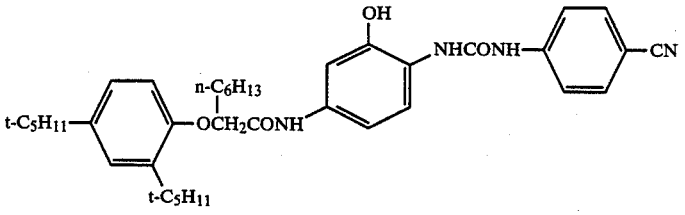
D-16
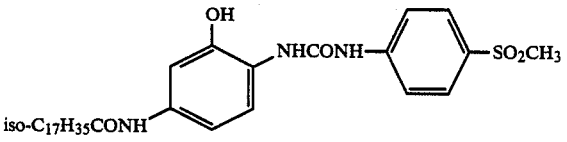
D-17
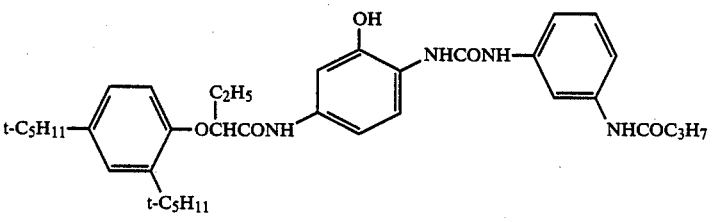
D-18
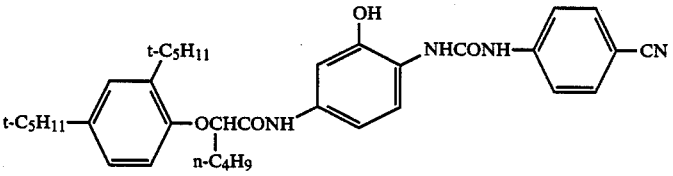

-continued

D-19

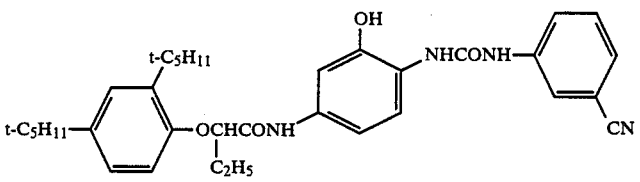

It is preferred in the present invention that the above 5-pyrazolone polymer magenta coupler be incorporated in at least one green-sensitive photographic emulsion layer and the above phenol cyan coupler in at least one red-sensitive photographic emulsion layer. Of course, in a case that there are only a single green-sensitive emulsion layer and a single red-sensitive emulsion layer, the above compounds are incorporated in these respective emulsion layers.

A typical example of yellow couplers which can be used in combination in the color light-sensitive material of the present invention is an anti-diffusing, hydrophobic acylacetamide-based coupler. Representative examples are described in U.S. Pat. Nos. 2,407,210, 2,875,057, 3,265,506, and so forth. In the present invention, it is preferred to use 2-equivalent yellow couplers. Typical examples of such couplers are oxygen atom-releasing type yellow couplers as described in U.S. Pat. Nos. 3,408,194, 3,447,928, 3,933,501 and 4,022,620, and nitrogen atom-releasing type yellow couplers as described in Japanese patent publication No. 10739/83, U.S. Pat. Nos. 4,401,752, 4,326,024, Research Disclosure (RD) 18053 (April 1979), British Pat. No. 1,425,020, West German patent application (OLS) Nos. 2,219,917, 2,261,361, 2,329,587, and 2,433,812, α-pivaroylacetoanilide-based couplers are excellent in the fastness, particularly light fastness of colored dye, and α-benzoylacetoanilide-based couplers produce a high color density.

Other couplers can be used in combination with the magenta and cyan couplers of the present invention. Magenta couplers which can be used in combination include oil protect-type indazolone or cyanoacetyl-based, preferably 5-pyrazolone-based and pyrazoloazole-based (e.g., pyrazolotriazoles) couplers. Of low molecular weight 5-pyrazolone-based couplers, couplers substituted with an arylamino group or an acylamino group in the 3-position are preferred from viewpoints of the hue of colored dye and the color density. Typical examples are described in U.S. Pat. Nos. 2,311,082, 2,343,703, 2,600,788, 2,908,573, 3,062,653, 3,152,896, 3,936,015 and so forth.

Low molecular weight or high molecular weight pyrazole-based couplers include pyrazolobenzimidazoles described in U.S. Pat. No. 3,369,879, preferably pyrazolo[5,1-c][1,2,4]triazoles, pyrazolotetrazoles as described in *Research Disclosure,* RD No. 2422 (June 1984), and pyrazolopyrazoles as described in *Research Disclosure,* RD No. 24230 (June 1984). In view of reduced yellow undesirable absorption of colored dye and light fastness, imidazo-[1,2-c]pyrazoles as described in European Pat. No. 119,741 are preferred. Pyrazolo-[1,5-b][1,2,4-triazole as described in European Pat. No. 119,860 is particularly preferred.

Cyan couplers which can be used in combination in the present invention include oil protect-type naphthol- and phenol-based couplers. Typical examples of such cyan couplers are naphthol-based couplers as described in U.S. Pat. No. 2,474,293, and preferably oxygen atom-releasing type 2-equivalent naphthol-based couplers as described in U.S. Pat. Nos. 4,052,212, 4,146,396, 4,228,233 and 4,296,200. Representative examples of the phenol-based couplers are described in U.S. Pat. Nos. 2,369,929, 2,801,171, 2,772,162, 2,895,826 and so forth. Cyan couplers which are fast to humidity and temperatures are preferably used in the present invention. Typical examples of such cyan couplers are phenol-based cyan couplers having an alkyl group (excluding an ethyl group) in the meta-position of the phenol nucleus as described in U.S. Pat. No. 3,772,002, and 2,5-diacylaminosubstituted phenol-based couplers as described in U.S. Pat. Nos. 2,772,162, 3,758,308, 4,126,396, 4,334,011, 4,327,173, West German patent application laid-open No. 3,329,729, Japanese patent application No. 47671/83 (U.S. Pat. No. 4,500,635), and so forth.

In a color light-sensitive material for cameras, to correct the unnecessary absorption in a short wavelength region of dye formed from the magenta and cyan couplers, it is preferred to use a colored coupler in combination. Typical examples of such colored couplers are yellow-coloring magenta couplers as described in U.S. Pat. No. 4,163,670 and Japanese patent publication No. 39413/82, and magenta-coloring cyan couplers as described in U.S. Pat. Nos. 4,009,929, 4,138,258, and British Pat. No. 1,146,368.

Graininess can be improved by using a coupler producing a colored dye having suitable diffusability. In connection with such fog couplers, representative examples of magenta couplers are described in U.S. Pat. No. 4,366,237 and British Pat. No. 2,125,570, and representative examples of yellow, magenta and cyan couplers are described in European Pat. No. 96,570 and West German patent application (OLS) No. 3,234,533.

With regard to various couplers which are used in the present invention, in order to satisfy the requirements for a particular light-sensitive material, two or more couplers can be incorporated in the same light-sensitive layer, or the same coupler can be incorporated in two or more different layers.

Couplers which are used in the present invention can be incorporated in the color light-sensitive material by various known techniques such as the solid dispersion method and the alkali dispersion method, preferably the latex dispersion method, and more preferably the oil-in-water dispersion method. In accordance with the oil-in-water dispersion method, a coupler is dissolved in a high boiling organic solvent having a boiling point of not less than 175° C., or a low boiling solvent, i.e., so-called auxiliary solvent, or a mixture thereof, and then finely dispersed in an aqueous medium such as water and an aqueous gelatin solution in the presence of a surface active agent. Examples of such high boiling organic solvents are described in U.S. Pat. No. 2,322,027. This dispersion may be accompanied by phase-reversion. If necessary, the dispersion may be used after removing the auxiliary solvent or reducing the amount of the auxiliary solvent by techniques such as distillation, noodle water-washing, and ultrafiltration.

Representative examples of the above high boiling organic solvents are phthalic acid esters (e.g., dibutyl phthalate, dicyclohexyl phthalate, di-2-ethylhexyl phthalate and decyl phthalate), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate), benzoic acid esters (e.g., 2-ethylhexyl benzoate, dodecyl benzoate, and 2-ethylhexyl-p-hydroxy benzoate), amides (e.g., diethyldecaneamide and N-tetradecylpyrrolidone), alcohols and phenols (e.g., isostearyl alcohol and 2,4-di-tert-amylphenol), aliphatic carboxylic acid esters (e.g., dioctyl azelate, glycerol tributyrate, isostearyl lactate, and trioctyl citrate), aniline derivatives (e.g., N,N-dibutyl-2-butoxy-5-tert-octylaniline), and hydrocarbons (e.g., paraffin, dodecylbenzene, and diisopropylnaphthalene).

As the auxiliary solvents, organic solvents having a boiling point of more than about 30° C., preferably from about 50° to 160° C. and the like can be used. Typical examples of these solvents are ethyl acetate, butyl acetate, ethyl propionate, methyl ethyl ketone, cyclohexanone, 2-ethoxyethyl acetate, and dimethylformamide.

The standard amount of the color coupler used is 0.001 to 1 mol per mole of light-sensitive silver halide. Preferably the amount of yellow coupler used is from 0.01 to 0.5 mol, the amount of magenta coupler used is from 0.003 to 0.3 mol, and the amount of cyan coupler used is from 0.002 to 0.3 mol. When the polymer coupler is used as a color coupler, the above amount of the color coupler is defined as based on a coupler unit.

As silver halide for use in the photographic emulsion layer of the color light-sensitive material of the present invention, any of silver bromide, silver iodobromide, silver iodochlorobromide, silver chlorobromide and silver chloride can be used. A preferred example of silver halide is silver iodobromide or silver iodochlorobromide containing 30 mol% or less of silver iodide. Particularly preferred is silver iodobromide containing from 2 to 25 mol% of silver iodide.

Silver halide grains in the photographic emulsion may be in a regular crystal form, such as cubic, octahedral and tetradecahedral, i.e., so-called regular grains, or in a irregular crystal form, such as spherical, or in a crystal form having a crystal defect such as a twinning plane, or composites thereof.

The size of the silver halide grains is not critical; finely divided grains having a particle size of not more than 1 micron to large grains having a particle size (as determined based a projected area) of 10 microns can be used. A mono-disperse emulsion having a narrow distribution or a multi-disperse emulsion having a broad distribution can be used.

Photographic emulsions which are used in the present invention can be prepared by known techniques such as the methods described in P. Glafkides, *Chimie et Physique Photographique,* Paul Montel (1967); G. F. Duffin, *Photographic Emulsion Chemistry,* Focal Press Corp. (1966), and V. L. Zelikman et al., *Making and Coating Photographic Emulsion,* Focal Press Corp. (1964). Any of the acid method, the neutral method, the ammonia method and so forth can be employed, and as a technique to react a soluble silver salt and a soluble halogen salt, any of the single jet method, the double jet method and a combination thereof can be employed. In addition, a method can be employed in which silver halide grains are formed in the presence of an excess of silver ions (so-called reverse mixing method). As one embodiment of the double jet method, a method in which the pAg of a liquid phase where silver halide is formed is kept constant, i.e., so-called controlled double jet method can be employed. This method permits preparation of a silver halide emulsion in which the crystal form is regular and the grain size is nearly uniform.

Two or more silver halide emulsions prepared separately may be used as a mixture thereof.

A silver halide emulsion containing regular silver halide grains as described above can be prepared by controlling pAg and pH during the formation of the grains. Details are described in *Photographic Science and Engineering,* Vol. 6, pp. 159–165 (1962); *Journal of Photographic Science,* Vol. 12, pp. 242–251 (1964); U.S. Pat. No. 3,655,384; and British Pat. No. 1,413,748.

The mono-disperse emulsion is described in Japanese patent application (OPI) Nos. 8600/73, 39027/76, 83097/76, 137133/78, 48521/79, 99149/79, 37635/83, 49938/83 (U.S. Pat. No. 4,497,895), Japanese patent publication No. 11386/72 (U.S. Pat. No. 3,574,628), U.S. Pat. No. 3,655,394, and British Pat. No. 1,413,748.

Tabular silver halide grains having an aspect ratio of not less than 5/1 can be used in the present invention. These tubular grains can be easily prepared by the methods described in Cleve, *Photography Theory and Practice,* page 131 (1930); Gutoff, *Photographic Science and Engineering,* Vol. 14, pp. 248–258 (1970); U.S. Pat. Nos. 4,434,226, 4,414,310, 4,433,048; and British Pat. No. 2,112,157. The tabular silver halide grains have advantages in that the covering power is increased and the color sensitization efficiency of sensitizing dye is increased. Such advantages are described in more detail in U.S. Pat. No. 4,434,226.

The silver halide grains may be of a uniform crystal structure, or of a halogen composition which is different between the inner and outer portions, or of a laminar structure. These grains are described in British Pat. No. 1.027,146, U.S. Pat. Nos. 3,505,068, 4,444,877 and Japanese patent application (OPI) No. 143331/85. Furthermore they may be joined to silver halide having a different composition through an epitaxial bond, or to compounds other than silver halide, such as silver rhodanide and lead oxide. Such grains are described in U.S. Pat. Nos. 4,094,684, 4,142,900, 4,459,353, British Pat. No. 2,038,792, U.S. Pat. Nos. 4,349,622, 4,395,478, 4,433,501, 4,630,087, 3,656,962, 3,852,067 and Japanese patent application (OPI) No. 162540/84 (U.S. Pat. No. 4,463,087).

In addition, a mixture of grains having various crystal forms can be used.

A silver halide solvent is useful to accelerate ripening. For example, it is known that to accelerate the ripening, an excess of halogen ion is made present in a reactor. It is therefore apparent that the ripening can be accelerated only by introducing a halide salt solution into the reactor. Other ripening agents can be used. The whole of the ripening agent can be added to a dispersion medium in the reactor before addition of silver and halide salts, or the ripening agent can be introduced in the reactor along with one or more halide salts, silver salts or peptizers. Moreover, the ripening agent can be added independently at the stage that the halide salt and silver salt are added.

As ripening agents other than halogen ions, ammonia, amine compounds, thiocyanate salts such as alkali metal thiocyanate, particularly sodium and potassium thiocyanate salts, and ammonium thiocyanate salts can be used. Use of such thiocyanate ripening agents is taught, e.g., in U.S. Pat. Nos. 2,222,264, 2,448,534 and 3,320,069. Commonly used thioether ripening agents as described, e.g., in U.S. Pat. Nos. 3,271,157, 3,574,628 and 3,373,313 can also be used. In addition, thione compounds as described in Japanese patent application (OPI) Nos. 82408/78 and 144319/78 (British Pat. No. 1,586,412) can be used.

Properties of silver halide grains can be controlled by providing the presence of various compounds at the stage of formation of silver halide precipitate. These compounds may be made present in the reactor at the beginning, or may be added along with one or more salts according to the usual procedure. Characteristics of silver halide can be controlled by making present the compounds of copper, iridium, lead, bismuth, cadmium, zinc (chalcogen compounds of sulfur, selenium, tellurium, etc.), gold, and Group VII noble metals at the stage of formation of silver halide precipitate as described in U.S. Pat. Nos. 2,448,060, 2,628,167, 3,737,313, 3,772,031, and *Research Disclosure,* Vol. 134, RD No. 13452 (June 1975). With the silver halide emulsion, as described in Japanese patent publication No. 1410/83 and Moisar et al., *Journal of Photographic Science,* Vol. 25, pp. 19–27 (1977), the inside of grains can be reduction sensitized at the stage of formation of precipitate.

The silver halide emulsion is usually chemically sensitized. Chemical sensitization can be carried out using active gelatin as described in T. H. James, *The Theory of the Photographic Process,* 4th Ed., Macmillan Co., pp. 67–76 (1977). In addition, as described in *Research Disclosure,* Vol. 120, RD No. 12008 (April 1974), Vol. 34, 13452 (June 1975), U.S. Pat. Nos. 2,642,361, 3,297,446, 3,772,031, 3,857,711, 3,901,714, 4,266,018, 3,902,415, and British Pat. No. 1,315,755, chemical sensitization can be carried out at pAg 5–10, pH 5–8 and temperature 30°–80° C. using sulfur, selenium, tellurium, gold, platinum, palladium, iridium and mixtures of two or more of these sensitizing agents. It is most suitable for the chemical sensitization to be carried out in the presence of gold compounds and thiocyanate compounds, or sulfur-containing compounds as described in U.S. Pat. Nos. 3,857,711, 4,266,018 and 4,054,457, or sulfur-containing compounds such as hypo, thiourea compounds, and rhodanine compounds. The chemical sensitization can be carried out in the presence of auxiliary chemical sensitizers. As these auxiliary chemical sensitizers, compounds known to prevent fog and increase sensitivity at the stage of chemical sensitization, such as azaindene, azapyridazine, and azapyrimidine can be used. Examples of auxiliary chemical sensitizers and reforming agents are described in U.S. Pat. Nos. 2,130,038, 3,411,914, 3,554,757, Japanese patent application (OPI) No. 126526/83 (British Pat. No. 2,125,981A) and the above cited test, G. F. Duffin, *Photographic Emulsion Chemistry.* In combination with or in place of the chemical sensitization, as described in U.S. Pat. Nos. 3,891,446 and 3,984,249, reduction sensitization using hydrogen, for example, can be applied, or as described in U.S. Pat. Nos. 2,518,698, 2,743,182 and 2,743,183, reduction sensitization can be applied using reducing agents such as stannous chloride, thiourea dioxide and polyamine, or by treatment at low pAg (e.g., less than 5) and/or high pH (e.g., more than 8). Color sensitivity can be increased by the chemical sensitization method described in U.S. Pat. Nos. 3,917,485 and 3,966,476.

Photographic emulsion which are used in the present invention may be subjected to spectral sensitization using known photographic sensitizing dyes. For the purposes of preventing fog during the preparation, storage and photographic processing of the color light-sensitive material, and of stabilizing the performance, known antifoggants or stabilizers can be used. Representative examples of such antifoggants or stabilizers and a method of use thereof are described in U.S. Pat. Nos. 3,954,474, 3,982,947, Japanese patent publication No. 28660/77, Research Disclosure, RD No. 17643 (December 1978), VIA to VIM, and E. J. Birr, *Stabilization of Photographic Silver Halide Emulsion,* Focal Press Corp. (1974).

The color light-sensitive material of the present invention may contain, as anti-color foggants and color mixing-preventing agents, hydroquinones, aminophenols, sulfoneamidophenols and the like. In the color light-sensitive material of the present invention, various anti-decoloring agents can be used. For this purpose, organic anti-decoloring agents such as 5-hydroxycumaranes and spirocumarones, and metal complex-based agents such as bis(N,N-dialkyldithiocarbamato)nickel complex can be used.

In the color light-sensitive material of the present invention, ultraviolet absorbers such as benzotriazoles can be used in combination. Typical examples of such ultraviolet absorbers are described in *Research Disclosure,* RD. No. 24239 (June 1984). The color light-sensitive material of the present invention may contain filter dyes or water-soluble dyes in a hydrophilic colloid layer for the purpose of preventing irradiation or halation.

As a binder for use in the photographic light-sensitive layer or back layer of the present invention, gelatin, modified gelatin, synthetic hydrophilic polymers and the like can be used. A hardening agent (e.g., vinylsulfone derivatives) may be incorporated in any suitable hydrophilic colloid layer. In addition, vinyl polymers containing a sulfinic acid salt in the side chain thereof can be used as hardening accelerating agents.

The color light-sensitive material of the present invention may contain at least one surface active agent as an auxiliary coating agent, or for various purposes of preventing charging, improving sliding properties, facilitating dispersion and emulsification, or improving photographic characteristics (acceleration of development, increasing contrast, and sensitization).

In addition to the above additives, stabilizers, contamination-preventing agents, developing agents or their precursors, development accelerating agents or their precursors, lubricants, mordants, matting agents, antistatic agents, and other various useful additives for the color light-sensitive material may be added to the color light-sensitive material of the present invention. Typical examples of such additives are described in *Research Disclosure,* RD Nos. 17643 (December 1978) and 18716 (November 1979).

The present invention is preferably applied to a color film for high sensitivity photographing, comprising a support and at least two layers on the support, said layers having the same color-sensing properties but having different sensitivities. In connection with the order in which layers are provided on the support, it is typical that a red-sensitive emulsion layer, a green-sensitive emulsion layer and a blue-sensitive emulsion layer be provided on the support in this order. There can be employed a reversion layer type arrangement that a high sensitivity layer is sandwiched between emulsion layers having different color sensitivites.

The color light-sensitive material of the present invention is treated with a developer containing an aromatic primary amine developing agent as a major component, and then, to remove developed silver, subjected to bleaching and fixation, bleach-fixation, or a combination thereof. If necessary, bleach accelerators such as iodine ions, thioureas, and thiol compounds may be used in combination. After bleach-fixation, or fixation, washing with water is applied. It is advantageous to save the amount of water used by countercurrently washing using two or more vessels. In addition, the multi-stage countercurrent stabilization treatment described in Japanese patent application (OPI) No. 8543/82 (U.S. Pat. No. 4,336,324) may be applied. In this treatment, a pH-adjusting buffer and formalin may be added. A preferred additive is an ammonium salt.

The present invention is described below in greater detail with reference to the following example.

EXAMPLE

Five multi-layer color light-sensitive materials (101 to 105), each comprising a cellulose triacetate film support and layers as shown below, were prepared. The formulation of an emulsion for each sample is as shown in Table 1.

Composition of Light-Sensitive Layer

In connection with the amount coated, silver halide and colloid silver are indicated in the unit of g/m$^2$, the coupler, additive and gelatin are indicated in g/m$^2$, and the sensitizing dye is indicated in number of mols per mol of silver halide in the same layer.

| | |
|---|---|
| First Layer (Antihalation layer) | |
| Black colloid silver | 0.2 g/m$^2$ |
| Gelatin | 1.3 g/m$^2$ |
| Ultraviolet absorber UV-1 | 0.1 g/m$^2$ |
| Ultraviolet absorber UV-2 | 0.2 g/m$^2$ |
| Dispersion oil Oil-1 | 0.01 g/m$^2$ |
| Dispersion oil Oil-2 | 0.01 g/m$^2$ |
| Second Layer (Intermediate layer) | |
| Finely divided silver bromide (average particle diameter: 0.07 μm) | 0.15 g/m$^2$ |
| Gelatin | 1.0 g/m$^2$ |
| Colored coupler EX-1 | 0.1 g/m$^2$ |
| Colored coupler EX-2 | 0.01 g/m$^2$ |
| Dispersion oil Oil-1 | 0.1 g/m$^2$ |
| Third Layer (First red-sensitive emulsion layer) | |
| Silver iodobromide emulsion (silver iodide: 3 mol %; average grain diameter: 0.3 μm) | 1.6 g/m$^2$ (as silver) |
| Gelatin | 1.6 g/m$^2$ |
| Sensitizing dye I | 4.5 × 10$^{-4}$ mol/silver halide 1 mol |
| Sensitizing dye II | 1.5 × 10$^{-4}$ mol/silver halide 1 mol |
| Coupler EX-3 | 1.0 g/m$^2$ |
| Coupler EX-4 | 0.02 g/m$^2$ |
| Coupler EX-2 | 0.003 g/m$^2$ |
| Dispersion oil Oil-1 | 0.03 g/m$^2$ |
| Dispersion oil Oil-3 | 0.012 g/m$^2$ |
| Fourth Layer (Second red-sensitive emulsion layer) | |
| Silver iodobromide emulsion (silver iodide: 6 mol %; average grain diameter: 0.7 μm) | 1.0 g/m$^2$ (as silver) |
| Gelatin | 1.0 g/m$^2$ |

-continued

| | |
|---|---|
| | (as silver) |
| Sensitizing dye I | 3 × 10$^{-4}$ mol/silver halide 1 mol |
| Sensitizing dye II | 1 × 10$^{-4}$ mol/silver halide 1 mol |
| Coupler EX-5 | 0.05 g/m$^2$ |
| Coupler EX-6 | 0.015 g/m$^2$ |
| Coupler EX-2 | 0.01 g/m$^2$ |
| Dispersion oil Oil-1 | 0.01 g/m$^2$ |
| Dispersion oil Oil-2 | 0.05 g/m$^2$ |
| Fifth Layer (Intermediate layer) | |
| Gelatin | 1.0 g/m$^2$ |
| Compound Cpd-A | 0.03 g/m$^2$ |
| Dispersion oil Oil-1 | 0.05 g/m$^2$ |
| Dispersion oil Oil-2 | 0.05 g/m$^2$ |
| Sixth Layer (First green-sensitive emulsion layer) | |
| Silver iodobromide emulsion (silver iodide: 4 mol %; average grain diameter: 0.3 μm) | 0.8 g/m$^2$ |
| Sensitizing dye III | 5 × 10$^{-4}$ mol/silver halide 1 mol |
| Sensitizing dye IV | 2 × 10$^{-4}$ mol/silver halide 1 mol |
| Gelatin | 1.0 g/m$^2$ |
| Coupler EX-7 | 0.6 g/m$^2$ |
| Coupler EX-4 | 0.06 g/m$^2$ |
| Coupler EX-1 | 0.15 g/m$^2$ |
| Dispersion oil Oil-1 | 0.5 g/m$^2$ |
| Seventh Layer (Second green-sensitive emulsion layer) | |
| Silver iodobromide emulsion (silver iodide: 6 mol %; average grain diameter: 0.7 μm) | 0.85 g/m$^2$ (as silver) |
| Gelatin | 1.0 g/m$^2$ (as silver) |
| Sensitizing dye III | 3.5 × 10$^{-4}$ mol/silver halide 1 mol |
| Sensitizing dye IV | 1.4 × 10$^{-4}$ mol/silver halide 1 mol |
| Coupler EX-9 | 0.05 g/m$^2$ |
| Coupler EX-10 | 0.01 g/m$^2$ |
| Coupler EX-11 | 0.08 g/m$^2$ |
| Coupler EX-1 | 0.02 g/m$^2$ |
| Coupler EX-8 | 0.02 g/m$^2$ |
| Dispersion oil Oil-1 | 0.10 g/m$^2$ |
| Dispersion oil Oil-2 | 0.05 g/m$^2$ |
| Eighth Layer (Yellow filter layer) | |
| Gelatin | 1.2 g/m$^2$ |
| Yellow colloid silver | 0.08 g/m$^2$ |
| Compound Cpd-B | 0.1 g/m$^2$ |
| Dispersion oil Oil-1 | 0.3 g/m$^2$ |
| Ninth Layer (First blue-sensitive emulsion layer) | |
| Monidisperse silver iodobromide emulsion (silver iodide: 4 mol %; average grain diameter: 0.3 μm) | 0.4 g/m$^2$ (as silver) |
| Gelatin | 1.0 g/m$^2$ (as silver) |
| Sensitizing dye V | 2 × 10$^{-4}$ mol/silver halide 1 mol |
| Coupler EX-12 | 0.9 g/m$^2$ |
| Coupler EX-4 | 0.07 g/m$^2$ |
| Dispersion oil Oil-1 | 0.2 g/m$^2$ |
| Tenth Layer (Second blue-sensitive emulsion layer) | |
| Silver iodobromide emulsion (silver iodide: 10 mol %; average grain diameter: 1.5 μm) | 0.5 g/m$^2$ (as silver) |
| Gelatin | 0.6 g/m$^2$ (as silver) |
| Sensitizing dye V | 1 × 10$^{-4}$ mol/silver halide 1 mol |
| Coupler EX-13 | 0.25 g/m$^2$ |
| Dispersion oil Oil-1 | 0.07 g/m$^2$ |
| Eleventh Layer (First protective layer) | |
| Gelatin | 0.8 g/m$^2$ |
| Ultraviolet absorber UV-1 | 0.1 g/m$^2$ |
| Ultraviolet absorber UV-2 | 0.2 g/m$^2$ |

-continued

| | |
|---|---|
| Dispersion oil Oil-1 | 0.01 g/m$^2$ |
| Dispersion oil Oil-2 | 0.01 g/m$^2$ |
| Twelfth Layer | |
| (Second protective layer) | |
| Finely divided silver bromide (average grain diameter: 0.07 μm) | 0.5 g/m$^2$ |
| Gelatin | 0.45 g/m$^2$ |
| Polymethyl methacrylate particles (diameter: 1.5 μm) | 0.2 g/m$^2$ |

-continued

| | |
|---|---|
| Hardener H-1 | 0.4 g/m$^2$ |
| Formaldehyde scavenger S-1 | 0.3 g/m$^2$ |
| Formaldehyde scavenger S-2 | 0.3 g/m$^2$ |

In each layer, as well as the above components, a surface active agent was added as an auxiliary coating agent.

The chemical structures and names of the above compounds are shown below.

UV-1

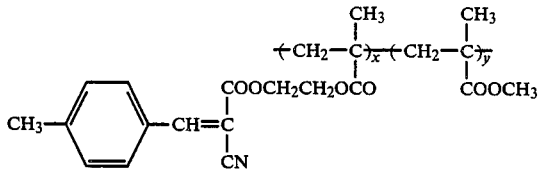

x/y = 7/3 (weight ratio)

UV-2

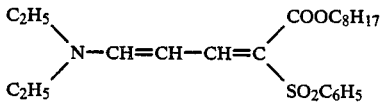

| | |
|---|---|
| Tricresyl phosphate | Oil-1 |
| Dibutyl phthalate | Oil-2 |
| Bis(2-ethylhexyl)phthalate | Oil-3 |

EX-1

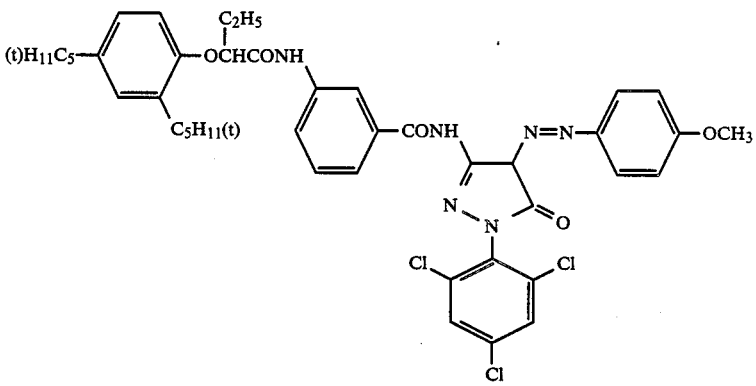

EX-2

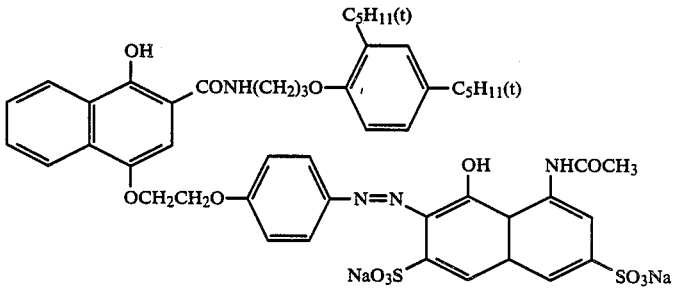

EX-3

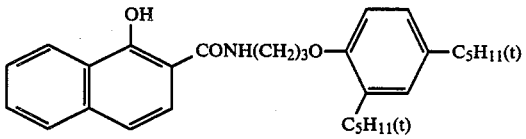

-continued
EX-4
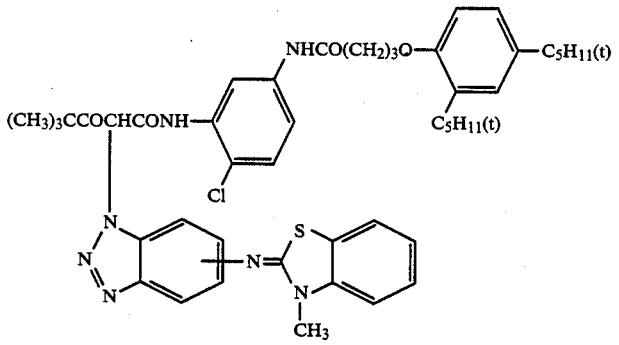
EX-5
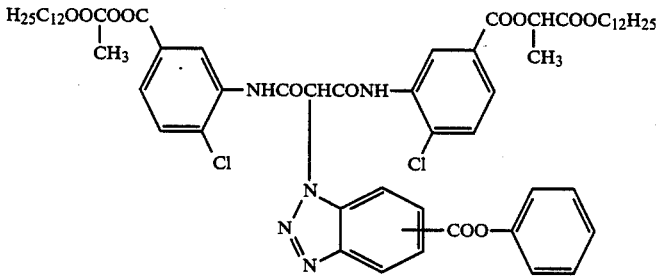
EX-6
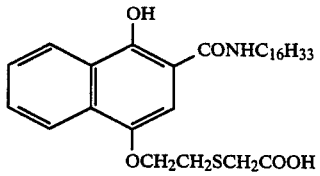
EX-7
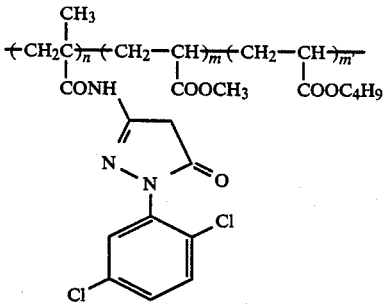
n/m + m' = 1
m/m' = 1
molecular weight = 15,000
EX-8
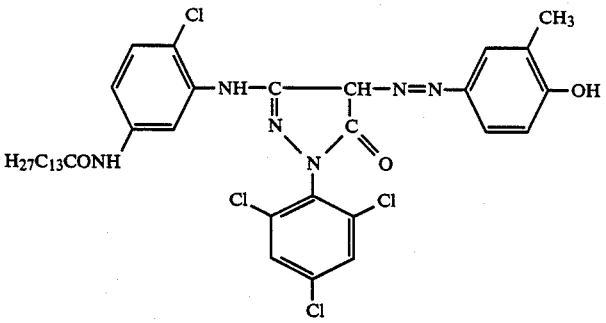

-continued
EX-9
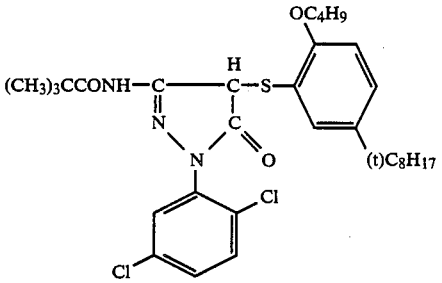
EX-10
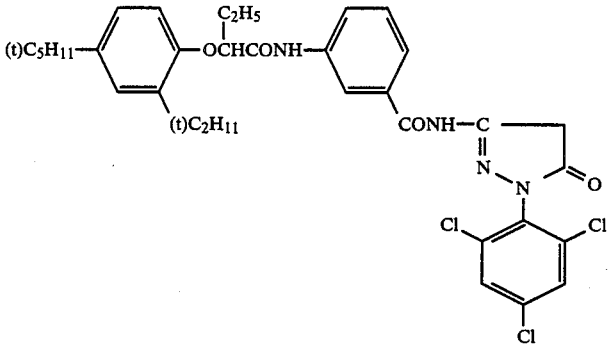
EX-11
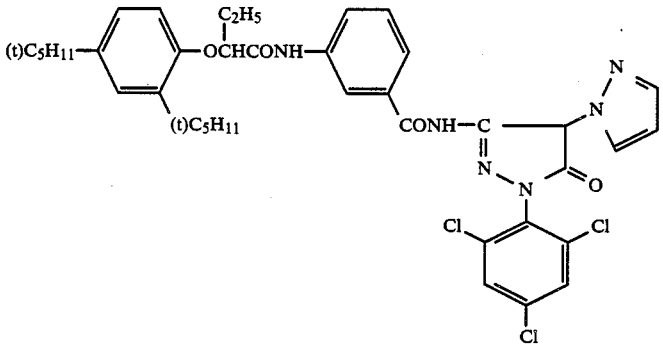
EX-12
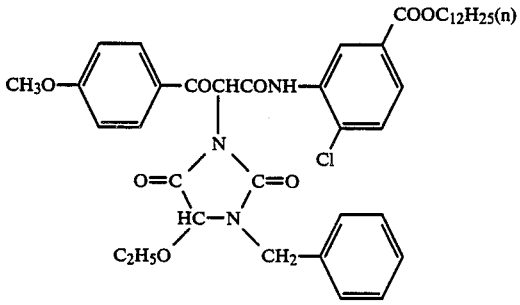
Cpd-A
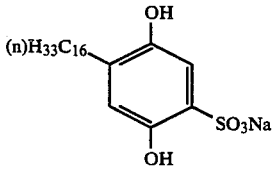

-continued

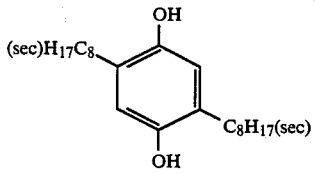

Cpd-B

Sensitizing dye I

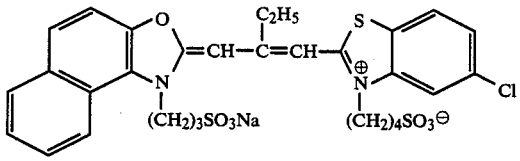

Sensitizing dye II

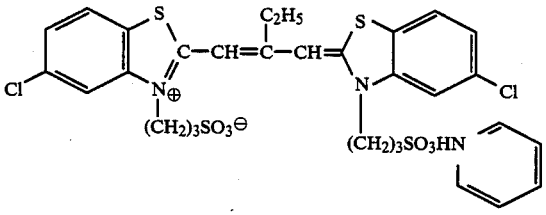

Sensitizing dye III

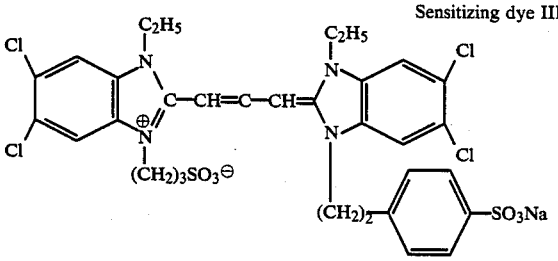

Sensitizing dye IV

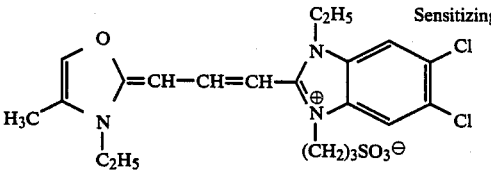

Sensitizing dye V

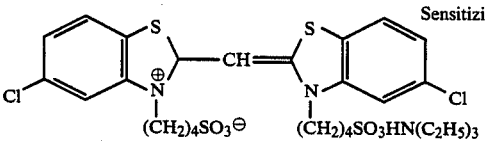

H-1

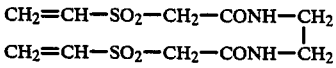

S-1

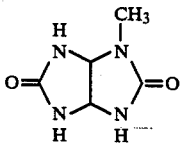

-continued

S-2

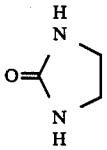

The above-prepared material was designated as Sample 101.

Samples 102 to 105

Samples 102 to 105 were prepared in the same manner as in Sample 101 except that the couplers of the third and sixth layers, respectively, were replaced with the couplers shown in Table 1. In Samples 103 and 105, the cyan couplers were mixed in a molar ratio of 1/1.

The materials thus prepared were each exposed to light through a conventional optical wedge and subjected to the developing processing shown below. Then each material was subjected to a two-week storage stability test in an atmosphere of 80° C. and 50% relative humidity (RH); a decrease in density from the initial density: $D_{min}+1.5$ was measured. The results are shown in Table 1.

| Development Processing | |
|---|---|
| Color development | 3 min. 15 sec. |
| Bleaching | 6 min. 30 sec. |
| Water-washing | 2 min. 10 sec. |
| Fixation | 4 min. 20 sec. |
| Water-washing | 3 min. 15 sec. |
| Stabilization | 1 min. 5 sec. |

The composition of the processing solution used at each step is shown below.

| | |
|---|---|
| Color Developer | |
| Diethylenetriamine pentaacetate | 1.0 g |
| 1-Hydroxyethylidene-1,1-diphosphoric acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—ethyl-N—β-hydroxyethylamino)-2-methylaniline sulfate | 4.5 g |
| Water to make | 1.0 liter (pH = 10.0) |
| Bleaching Solution | |
| Iron (III) ammonium ethylenediamine-tetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter (pH = 6.0) |
| Fixer | |
| Disodium ethylenediaminetetraacetate | 1.0 g |
| Sodium sulfite | 4.0 g |
| 70% Aqueous solution of ammonium thiosulfate | 175.0 ml |

-continued

| | |
|---|---|
| Sodium Hydrogensulfite | 4.6 g |
| Water to make | 1.0 liter (pH = 6.6) |
| Stabilizer | |
| Formalin (40 wt % formaldehyde) | 2.0 ml |
| Polyoxyethylene-p-monononylphenyl ether (average degree of polymerization = about 10) | 0.3 g |
| Water to make | 1.0 liter |

TABLE I

| Sample | Cyan Coupler | Decrease in Density of Cyan Dye* | Magenta Coupler | Decrease in Density of Magenta* |
|---|---|---|---|---|
| 101 | EX-3 | 0.4 | EX-7 | 0.25 |
| 102 | EX-3 | 0.4 | C-1 | 0.07 |
| 103 | D-15 | | | |
| | D-18 | 0.10 | C-1 | 0.07 |
| 104 | D-2 | 0.12 | C-1 | 0.07 |
| 105 | D-15 | | | |
| | D-18 | 0.10 | C-9 | 0.06 |

Note:
Samples 101 and 102: Comparative examples
Samples 103 to 104: Examples of the present invention
*Decrease in density after 2 weeks storage at 80° C., 50% RH.

It can be seen from the results of Table 1 that when the cyan coupler and magenta coupler combination of the present invention is used, the fading is most decreased, and the balance in fading between the cyan and magenta dye images is excellent.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support and at least two silver halide emulsion layers on the support, wherein at least one silver halide emulsion layer contains at least one 2-equivalent 5-pyrazolone polymer coupler and at least one other silver halide emulsion layer contains at least one phenol cyan coupler which is substituted with an acylamino group in the 5-position and with a ureido group in the 2-position, wherein the 2-equivalent 5-pyrazolone polymer coupler has a repeating unit represented by formula (II) and is derived from a monomer coupler represented by formula (I)

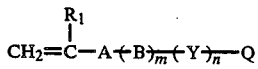

(I)

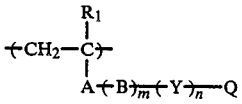

(II)

wherein $R_1$ represents a hydrogen atom, a lower alkyl group having from 1 to 4 carbon atoms, or a chlorine atom, A represents —CONH—, —COO—, —O—, or a phenylene group, B represents an unsubstituted or substituted straight or branched alkylene group, aralkylene group, or phenylene group, Y represents —CONR'—, —NR'CONR'—, —NR'COO—, —NR'CO—, —OCONR'—, —NR'—, —COO—, —OCO—, —CO—, —O—, —$SO_2$—, —NR'$SO_2$— or —$SO_2$NR'—, wherein R' represents a hydrogen atom or substituted or unsubstituted aliphatic group or aryl group, and when two or more R's are present in one molecule, R's may be same or different, n is 0 or 1, m is 0 when n is 0, or 1 when n is 1, and Q represents a 2-equivalent magenta coupler group forming a dye when coupling with an oxidized product of an aromatic primary amine developing agent.

2. A silver halide color photographic material as in claim 1, wherein Q represents a pyrazolone group represented by formula (III) or (IV)

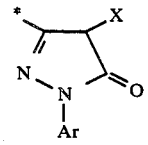

(III)

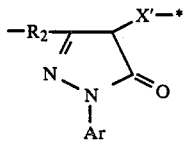

(IV)

wherein in formulae (III) and (IV), the symbol * indicates a site where the group is linked to $-(Y)_n-$ Ar represents a substituted or unsubstituted alkyl group or aryl group; $R_2$ represents a substituted or unsubstituted anilino group, an acylamino group, or ureido group; X represents a coupling-releasable group linked to the coupling position through a nitrogen atom, a sulfur atom or an oxygen atom; and X' represents a divalent group derived from X, having bonding sites to pyrazolone ring and to $-(Y)_n-$ 3. A silver halide color photographic material as in claim 2, wherein X represents nitrogen atom-containing groups forming a heterocyclic ring.

4. A silver halide color photographic material as in claim 1, wherein said 2-equivalent 5-pyrazolone polymer coupler is a copolymer wherein the color-forming portion represented by formula (I) is from 5 to 80 wt%.

5. A silver halide color photographic material as in claim 1, wherein said 2-equivalent 5-pyrazolone polymer coupler is a copolymer wherein the color-forming portion represented by formula (I) is from 20 to 70 wt%.

6. A silver halide color photographic material as in claim 4, wherein the molecular weight equivalent of the 2-equivalent 5-pyrazolone polymer coupler is from about 250 to 4,000.

7. A silver halide color photographic material as in claim 1, wherein the phenol cyan coupler is represented by formula (V)

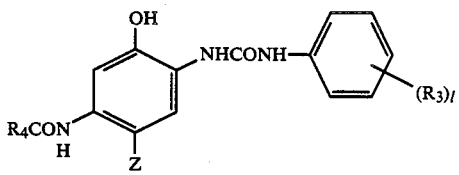

(V)

wherein $R_4$ represents a substituted or unsubstituted alkyl group, aryl group, or heterocyclic group;

$R_3$ represents a group selected from a hydrogen atom, a halogen atom, a sulfonyl group, a sulfonamido group, a sulfamoyl group, a polyfluoroalkyl group, an acryl group, an alkoxycarbonyl group, an acyl group, an amino group, and a cyano group;

l is an integer of 1 to 5, and when l is two or more, the groups represented by $R_3$ are the same or different; and Z represents a hydrogen atom or a group capable of being released at a time of oxidative coupling with a developing agent.

8. A silver halide color photographic material as in claim 1, wherein the phenol coupler is represented by formula (V)

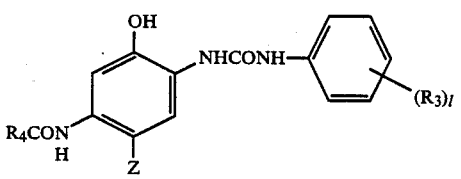

(V)

wherein $R_4$ represents a substituted or unsubstituted alkyl group, aryl group, or heterocyclic group;

$R_3$ represents a group selected from a hydrogen atom, a halogen atom, a sulfonyl group, a sulfonamido group, a sulfamoyl group, a polyfluoroalkyl group, an acryl group, an alkoxycarbonyl group, an acyl group, an amino group, and a cyano group;

l is an integer of 1 to 5, and when l is two or more, the groups represented by $R_3$ are the same or different; and Z represents a group capable of being released at a time of oxidative coupling with a developing agent.

9. A silver halide color photographic material as in claim 2, wherein the phenol coupler is represented by formula (V)

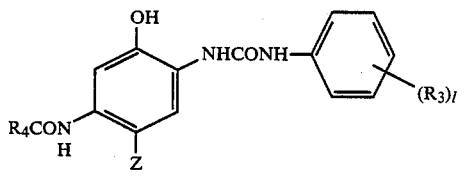

(V)

wherein $R_4$ represents a substituted or unsubstituted alkyl group, aryl group, or heterocyclic group;

$R_3$ represents a group selected from a hydrogen atom, a halogen atom, a sulfonyl group, a sulfonamido group, a sulfamoyl group, a polyfluoroalkyl group, an acryl group, an alkoxycarbonyl group, an acyl group, an amino group, and a cyano group;

l is an integer of 1 to 5, and when l is two or more, the groups represented by $R_3$ are the same or different; and Z represents a group capable of being released at a time of oxidative coupling with a developing agent.

10. A silver halide color photographic material as in claim 9, wherein in the phenol coupler of the formula (V), $R_4$ represents aryloxy substituted alkyl group and Z represents a hydrogen atom, a halogen atom or an aryloxy group.

11. A silver halide color photographic material as in claim 1, wherein the 2-equivalent 5-pyrazolone polymer coupler is incorporated in at least one green-sensitive photographic emulsion layer and the phenol cyan coupler is incorporated in at least one red-sensitive photographic emulsion layer.

12. A silver halide color photographic material as in claim 9, wherein the amount of 2-equivalent 5-pyrazolone polymer coupler is from 0.003 to 0.3 mol per mole of light-sensitive silver halide in the emulsion layer in which said coupler is incorporated, and the amount of the phenol cyan coupler is from 0.002 to 0.3 mol per mol of light-sensitive halide in the silver halide emulsion layer in which said phenol cyan coupler is incorporated.

* * * * *